US005174323A

United States Patent [19]

Haselden

[11] Patent Number: 5,174,323

[45] Date of Patent: Dec. 29, 1992

[54] LIQUID MATERIAL RESERVOIR

[76] Inventor: Kent Haselden, 1700 Whipple Rd., Mt. Pleasant, S.C. 29464

[21] Appl. No.: 844,180

[22] Filed: Mar. 2, 1992

[51] Int. Cl.[5] ..... F17C 1/00

[52] U.S. Cl. ..... 137/209; 137/240; 137/572

[58] Field of Search ..... 137/209, 206, 240, 572, 137/571

[56] References Cited

U.S. PATENT DOCUMENTS 3,626,970 12/1971 Jones ..... 137/209

4,669,496 6/1987 Kemp ..... 137/209

4,941,593 7/1990 Hicks ..... 137/240 X 5,069,244 12/1991 Miyazaki ..... 137/240 X

*Primary Examiner*—Alan Cohan

*Attorney, Agent, or Firm*—B. Craig Killough

[57] ABSTRACT

A liquid material reservoir which is used to collect liquid within a liquid or fluid transport system which is purged by means of introducing pressurized gas such as carbon dioxide into the system. As the pressurized gas is introduced into the system, liquid material which is purged from the system is forced into the reservoir, from which it may be reclaimed.

5 Claims, 2 Drawing Sheets

LIQUID MATERIAL RESERVOIR

BACKGROUND OF THE INVENTION

The invention relates to liquid or fluid transport systems generally, and is specifically directed to a reservoir which reduces or eliminates the loss of liquid material when cleaning transport lines by means of pressurized gas introduced into the transport lines.

A liquid transport system may incorporate a storage or holding tank in which a liquid material is stored. The liquid material is transported from the storage tank by pipes or other lines for distribution as desired. Typically, the distribution will be for further mixing or processing of the liquid material, or for the filling of smaller containers.

In most liquid distribution systems, it is necessary at some point in time to clean the lines, which are in the nature of piping or tubing, or to otherwise eliminate the liquid material from the piping or tubing. In some industries, it is necessary to eliminate the liquid material from the lines several times a day. For example, the same system of pipes may be used to distribute many different liquid materials. To avoid mixing the various liquid materials, the materials must be eliminated from the piping or tubing.

A common means of eliminating liquid material from the piping system is to inject pressurized gas into the piping system. The pressurized gas, which may be an inert gas, or carbon dioxide, or other suitable material, will push the liquid material through the pipes. However, it is very common that the pressurized gas will push a portion of the liquid material through the pipes, but then will bypass the liquid material, leaving a portion of the liquid material within the pipes. The remaining liquid material is usually drained from the pipes, and is frequently wasted. Accordingly, the gas pressurization means of eliminating the liquid material from the pipes is not completely effective, resulting in waste, and often times, in the loss of the valuable liquid material.

SUMMARY OF THE PRESENT INVENTION

The present invention provides a reservoir into which the liquid material may be transported from the holding or storage tank. The reservoir then holds a predetermined amount of the liquid material and distributes the liquid material, such as by gravity means, to the distribution point within the system.

Typically, the liquid material will be pumped by mechanical means from the storage tank into the reservoir. The reservoir will receive the liquid material, and will hold a predetermined amount of liquid material. The liquid material will flow from the reservoir into an outlet pipe for distribution as desired.

The level of the liquid material is controlled within the reservoir by head pressure due to air or other gas present within the reservoir. A valve on the upper portion of the reservoir releases gas as desired to allow the liquid level of the reservoir to be increased as desired, or retains gas within the reservoir to prevent the flow of liquid material into the reservoir by the presence of head pressure.

The liquid material is purged from the distribution system by the introduction or pressurized gas into the system near the storage tank. The pressurized gas will force the remaining liquid from the pipes into the reservoir. A valve, which is located near the inlet to the reservoir, directs the pressurized gas into the reservoir to force the remaining liquid out of the reservoir. The valve may be controlled by a sensor which senses the pressure of air and the absence of liquid material.

DETAILED DESCRIPTION OF THE DRAWINGS

DETAILED DESCRIPTION OF THE PREFERRED EMBODIMENT

Figure 1:
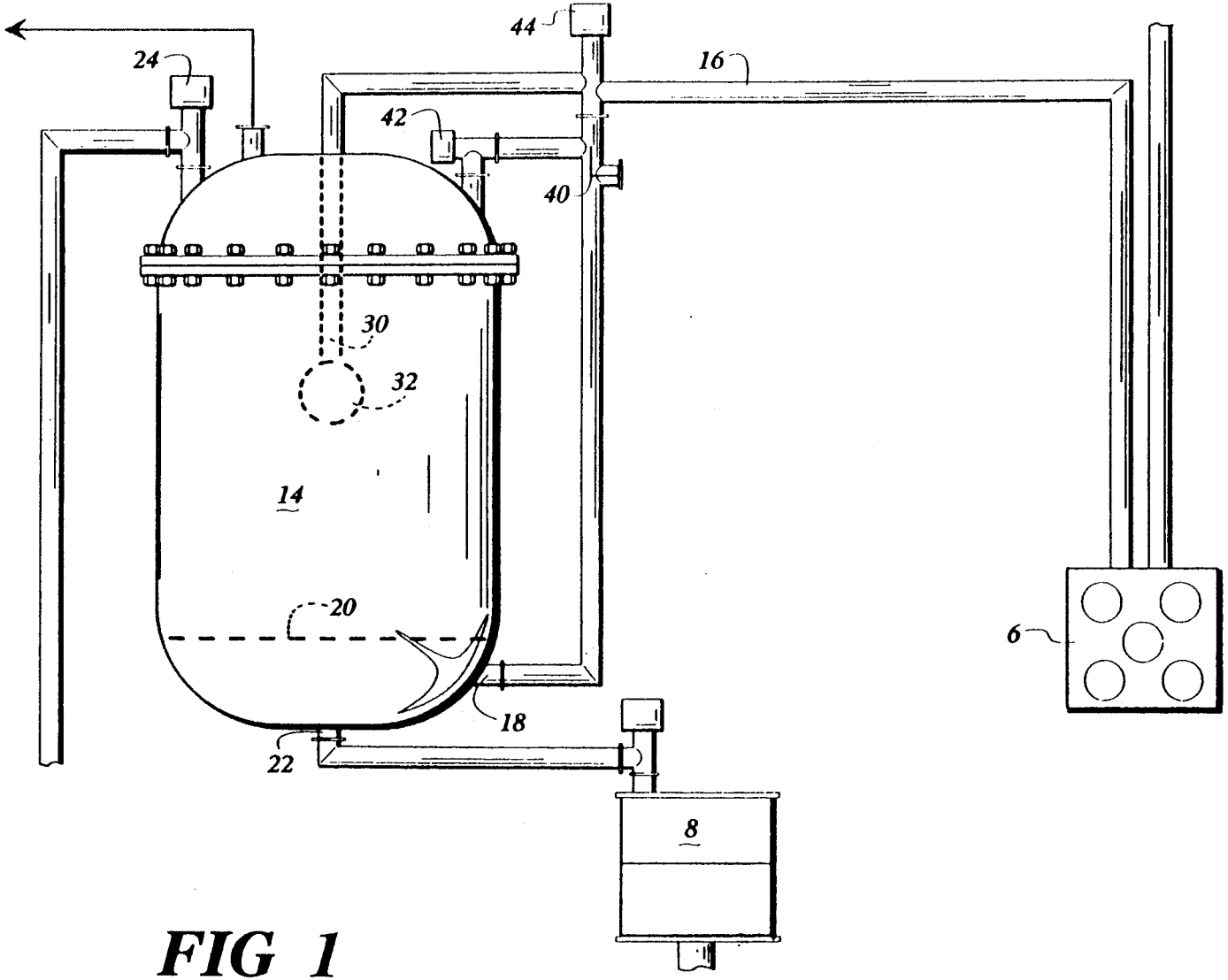
FIG. 1 shows a reservoir as it appears in a soft drink bottling system, with soft drink syrup concentrate introduced into the reservoir.
Figure 2:
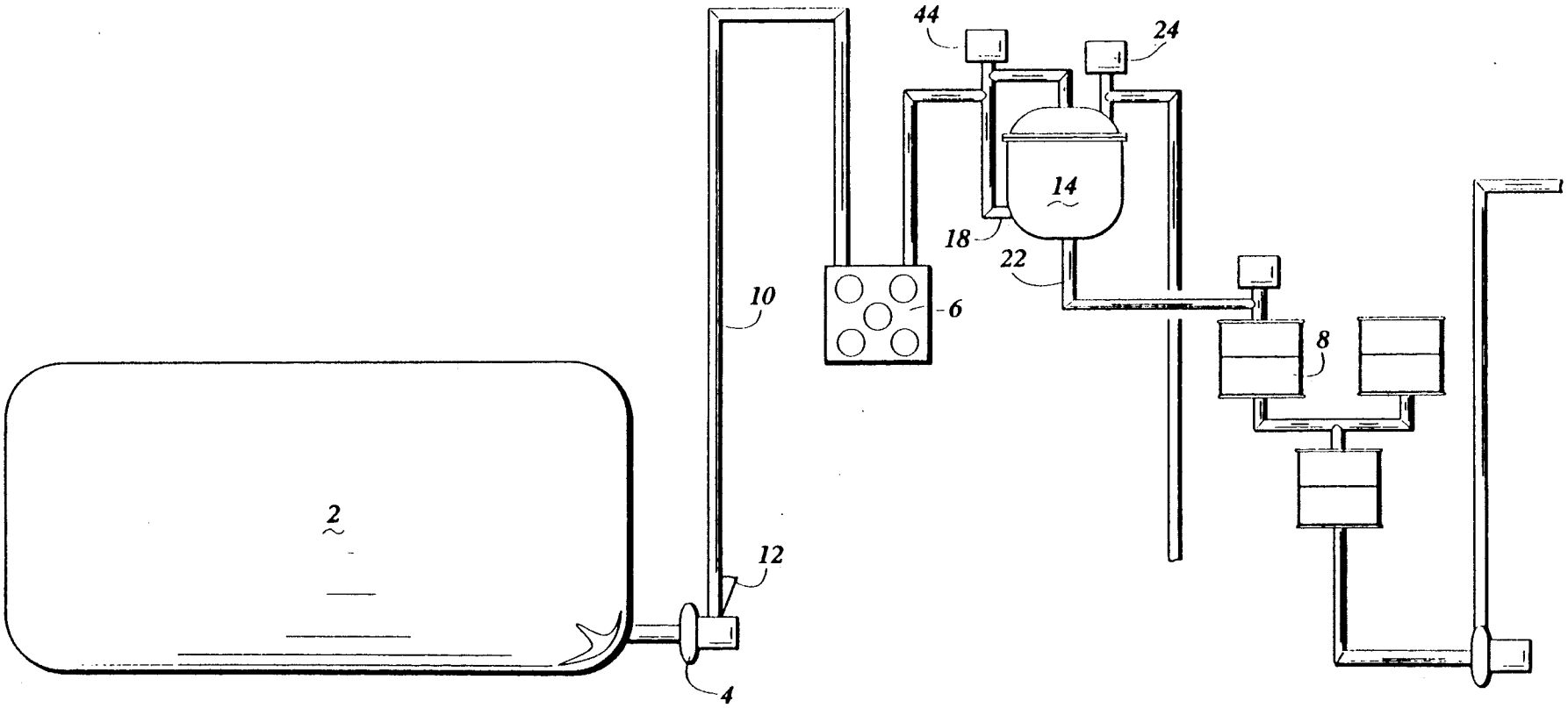
FIG. 2 is a schematic diagram indicating the reservoir as it appears within a soft drink bottling system.

In the preferred embodiment the reservoir of the invention is incorporated within a typical soft drink bottling distribution system. The reservoir could be used within any liquid transport system where pipes or tubes are used to transport liquid material, and pressurized gas, such as carbon dioxide, is used to purge the liquid material from the pipes or tubes. The invention allows for almost complete elimination of the liquid where pressurized gas fails to completely purge the liquid, resulting in waste.

In a soft drink bottling system, the concentrated soft drink syrup is stored in bulk, typically in a storage tank 2. A mechanical pump 4, such as one powered by an electric motor, is used to pump the syrup from the tank 2 for processing.

The syrup is transported for mixing with water to the desired concentration. After the syrup is mixed with water, it is transported further for carbonation, and after carbonation, the soft drink is bottled or canned.

The same equipment is typically used to mix various brands of soft drink. Accordingly, a switch or divert panel 6 is used to choose the desired syrup from one of several tanks, and to introduce a syrup into the mix unit 8, where the desired syrup is mixed with water.

It is necessary from time to time to purge the syrup from the lines. The syrup is purged for cleaning, or the syrup is purged after a run of a particular brand of syrup, prior to the initiation of bottling of the next brand of syrup.

To purge a line 10, a gas, such as carbon dioxide, is introduced into the line after the operation of the pump from the storage tank is terminated, and the valve from the storage tank is closed. The pressurized gas is introduced at an injection point 12 near the tank 2, and pushes the liquid through the lines toward the mix unit 8 so as to use the syrup which remains in the lines.

However, as the carbon dioxide increases in volume within the lines, and as the liquid decreases in volume, the carbon dioxide will begin to flow past, or bypass, the liquid. As the carbon dioxide passes the liquid, the pressure from the gas is no longer pushing the liquid. Typically, a substantial amount of liquid syrup is within the lines. The liquid syrup must then be drained from the lines, and is usually wasted. For a typical bottling system, about 40 to 50 gallons of syrup is wasted each time the lines are purged to run a different brand of syrup.

The use of the reservoir 14 of the present invention collects the syrup as it is pushed through the lines, either by pumping or by gas pressure, and reduces the waste when the lines are purged. In the preferred embodiment, the reservoir is placed within the system between the syrup tank and the flow mix unit.

The reservoir 14 is shown in detail in FIG. 1. Syrup enters the tank as it exits the divert panel 6 and travels through line 16 to an inlet means 18. It is desired that the inlet means 18 is located on the reservoir below the typical level 20 of the syrup within the reservoir.

The syrup flows into the reservoir tank to a desired level 20. An outlet means 22 is provided on the bottom, or a lower portion of the reservoir tank to permit flow of the syrup or liquid material from the reservoir tank by gravity means. In the preferred embodiment, the reservoir tank is positioned above subsequent, or downstream, processing equipment so that the liquid material is removed from the tank by gravity flow.

The desired level is maintained within the tank 14 as a result of head pressure created from air or carbon dioxide or other gas present within the reservoir tank. A valve 24 located on a upper portion of the tank 14 releases the gas to allow the syrup to rise to the desired level within the tank. When the valve is closed, as long the syrup is introduced into the tank 14 through the inlet means, which is preferably located below the desired level, the level of syrup within the reservoir will remain relatively constant by means of the head pressure within the reservoir.

Valve 24, used to regulate the syrup level by regulating the amount of air which is present in the tank 14, may be controlled manually, by a timer, or by a switch means which is actuated by the level of syrup within the tank 14.

When it is desired to clean the system or change over production to a different product, the lines are purged by means of the pressurized gas such as carbon dioxide. Valve 24 is opened, and the gas is introduced into the system at the injection point 12. The gas travels through the line 10, divert panel 6, and through line 16. A probe 40 senses whether a liquid or a gas is present within line 16. If a liquid is present, valve 42, which is actuated by probe 40, remains closed and the liquid material, such as syrup, travels through inlet 18 into the tank. However, if the probe senses that a gas is present within line 16, valve 42 is opened, which allows the pressurized gas to enter through the top of the reservoir tank 14. By introducing the pressurized gas to the top of the reservoir tank, syrup or liquid material 20 is forced through the outlet means 22 to purge the system.

The tank 14 functions to collect the syrup as the lines are purged by the pressurized gas, or carbon dioxide is introduced under pressure into the lines. The carbon dioxide forces all of the liquid material into the reservoir, resulting in virtually no waste.

In selecting the size of the reservoir tank 14, it is necessary that the tank be able to hold the liquid which is present in the lines upstream of the reservoir tank. Accordingly, the volume of the tank 14 should be greater than the volume of the line from the storage tank 2 so as to receive all the liquid material that is purged from the lines.

Cleaning means 30 may be provided for the reservoir tank. A pipe or line may be introduced into the tank, with nozzles 32 provided from the line and located within the tank provided to direct the spray of a cleaning solution so as to clean the tank. Means may be provided for introducing the cleaning solution into the lines, such as by means of a valve which directs the flow of the cleaning solution into the cleaning solution lines.

Valve 44 directs the cleaning solution into the cleaning means 30. Valve 44 is closed to prevent liquid flow into the top of the reservoir when the system is in normal use.

What is claimed is:

1. A material reservoir for use within a liquid transport system, comprising:

a. a reservoir tank located between a storage means and a distribution of processing means into which a liquid material is transported from said storage means;

b. an inlet means into said reservoir tank connected to the storage tank which allows said liquid material to be transported into said reservoir tank from said storage means;

c. an outlet means located on a lower surface of said reservoir tank from which said liquid material flows from said reservoir tank to said distribution means;

d. a valve located on an upper surface of said tank which controls level of liquid within said tank by opening to allow gas which is present within said reservoir tank to exit said reservoir tank and allow said liquid material to enter said tank, and which closes to create a head pressure by means of said gas to prevent a greater volume of liquid from entering said tank; and e. a valve in a line located between said storage means and an upper part of said reservoir tank which directs said liquid material into said inlet means when closed, but which may be opened so as to allow pressurized gas to enter said reservoir tank above the level of said liquid material and force said liquid material out of said reservoir tank through said outlet means so as to purge the transport system.

2. A material reservoir for use in a liquid transport system as described in claim 1, wherein cleaning means for said reservoir tank is located within said reservoir tank.

3. A material reservoir for use in a liquid transport system as described in claim 1, wherein said valve located between said storage means and said reservoir tank is controlled by a sensor so as to close said valve when a liquid material is present and to open said valve when a gas is present in a line which leads to said inlet means.

4. A material reservoir for use in a liquid transport system as described in claim 2, wherein said valve located between said storage means and said reservoir tank is controlled by a sensor so as to close said valve when a liquid material is present and to open said valve when a gas is present in a line which leads to said inlet means.

5. A material reservoir for use within a transport system, comprising:

a. a reservoir tank located between a storage means and a distribution or processing means into which a liquid material is transported from said storage means;

b. an inlet means into said reservoir tank connected to the storage tank which allows said liquid material to be transported into said reservoir tank from said storage means;

c. an outlet means located on a lower surface of said reservoir tank from which said liquid material flows from said reservoir tank to said distribution means;

d. a valve in a line located between said storage means and an upper part of said reservoir tank which directs said liquid material into said inlet means when closed, but which may be opened so as to allow pressurized gas to enter said reservoir tank above the level of said liquid material and force said liquid material out of aid reservoir tank through said outlet means so as to purge the transport system; and e. a sensor means in a line located between said storage means and an upper part of said reservoir tank which closes said vlave when a liquid material is present within said line where said sensor is located, and which opens said valve when a gas is present in said line.

* * * * *